US006964490B2

(12) United States Patent
Scholz

(10) Patent No.: US 6,964,490 B2
(45) Date of Patent: Nov. 15, 2005

(54) SURGICAL LIGHT

(75) Inventor: Manfred Scholz, Seitingen-Oberflacht (DE)

(73) Assignee: Berchtold Holding GmbH, Tuttlingen (DE)

( * ) Notice: Subject to any disclaimer, the term of this patent is extended or adjusted under 35 U.S.C. 154(b) by 0 days.

(21) Appl. No.: 10/374,493

(22) Filed: Feb. 25, 2003

(65) Prior Publication Data

US 2003/0165055 A1 Sep. 4, 2003

(30) Foreign Application Priority Data

Mar. 4, 2002 (DE) ..... 102 09 533

(51) Int. Cl.[7] ..... A61G 13/00
(52) U.S. Cl. ..... 362/33; 362/285; 362/804
(58) Field of Search ..... 362/276, 33, 277, 362/285, 418, 804

(56) References Cited

U.S. PATENT DOCUMENTS 4,639,838 A * 1/1987 Kato et al. ..... 362/33
5,001,616 A * 3/1991 Gehly et al. ..... 362/308
5,067,064 A 11/1991 Gehly et al. ..... 362/277
5,383,105 A * 1/1995 Agut ..... 362/285
6,132,062 A * 10/2000 Borders et al. ..... 362/251
6,644,837 B2 * 11/2003 Borders et al. ..... 362/399

FOREIGN PATENT DOCUMENTS

DE 945 082 C 6/1956 ..... F21S 8/00
EP 0 299 196 A 1/1989 ..... F21M 1/00

OTHER PUBLICATIONS

DE Search Report, Aug. 21, 2003, Germany.
DE Search Report, Aug. 21, 2003, Germany.

* cited by examiner

*Primary Examiner*—Y. My Quach-Lee
*Assistant Examiner*—Peggy A. Neils
(74) *Attorney, Agent, or Firm*—Sierra Patent Group, Ltd.

(57) ABSTRACT

A surgical light has a device for the variation of the light field and a device for the setting of the luminous flux, with additionally a device being provided for the detection of a variation in the light field.

15 Claims, 2 Drawing Sheets

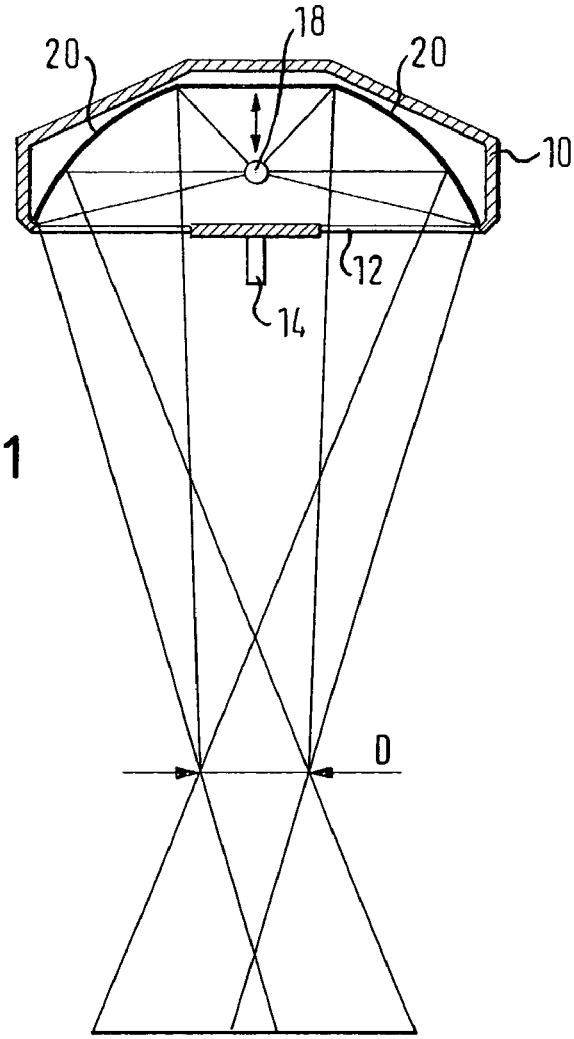
FIG. 1
FIG. 2
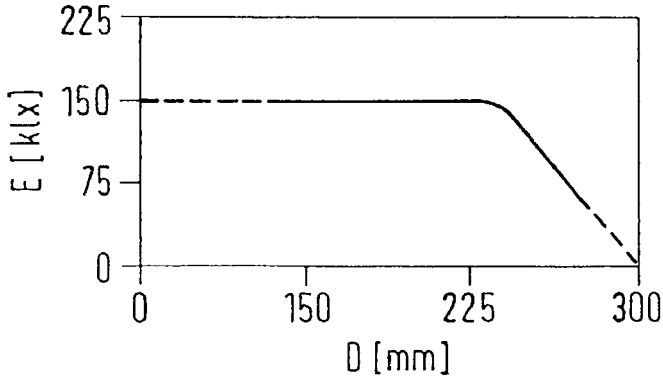

SURGICAL LIGHT

PRIORITY CLAIM

This application claims priority of German Patent Application 102 09 533.7, filed Mar. 4, 2002.

BACKGROUND

The present invention relates to a method for the control of the illuminance of a surgical light as well as to a surgical light for the carrying out of the method.

In modern surgical lights, the light field generated, i.e. the illuminated area on the operating table, is adjustable by hand or by a motor since different surgical openings have different sizes and depths which require light fields of different sizes. It is disadvantageous here that, on the enlargement of the light field, the illuminance, i.e. the ratio of the luminous flux incident perpendicularly and the size of the illuminated area, falls, since the luminous flux is distributed over a larger area.

SUMMARY

It is the object of the invention to provide a method for the control of the illuminance of a surgical light as well as a surgical light for the carrying out of the method with which an improved illumination can be achieved in an operation.

In particular a method for the control of the illuminance of a surgical light which has at least one lighting means. The light field of the surgical light is variable in its size, with a variation of the light field being detected. The luminous flux of the surgical light is varied as the light field varies by a control and/or regulating means such that the illuminance adopts a substantially constant desired value.

The desired illuminance can be selected by the surgeon or also be pre-set. If the light field is varied, for example enlarged, in an operation, this variation in the light field is detected by a sensor and the luminous flux of the surgical light is increased by the control and/or regulation means such that the illuminance at the operating location remains the same.

The operational comfort is increased by the method in accordance with the invention, since the illuminance does not have to be manually re-adjusted when the light field becomes larger. A substantially improved illumination of the operating location is achieved, on the other hand, since the surgeon always finds an unchanging illuminance-irrespective of the size of the light field.

In accordance with a first advantageous embodiment of the method in accordance with the invention, the luminous flux of the surgical light can be selected to be lower than the maximum possible luminous flux and the luminous flux can be increased as the light field becomes larger. In this method variant, a luminous flux reserve is thus maintained which is used when the light field becomes larger in order to achieve an illuminance which remains the same. This method variant can be used particularly advantageously with lighting means with which relatively high illuminance values (for example, 180,000 1×) can be achieved.

In accordance with a further embodiment, at least one component of the surgical light is moved mechanically for the variation of the light field, with this movement being detected by a sensor whose output signal is used as a control variable for the variation of the luminous flux of the surgical light. For the variation of the light field, the lighting means can, for example, itself be adjustable via a motor or via a turning of a handle of the surgical light. It is also possible to adjust parts of a reflector provided in the surgical light. The sensor detects this adjustment movement so that the sensor signal can be used to vary the luminous flux of the surgical light and thereby to keep the illuminance constant.

It is in particular advantageous in the aforesaid variant for a knob or a handle of the surgical light to be rotated for the variation of the light field, with this rotation being detected by the sensor. For example, the rotation of the handle, which simultaneously brings about an adjustment of the lighting means, can be detected via a potentiometer or an encoding disk, whereby a control signal is received in a simple manner.

In accordance with a further variant of the method, the desired value of the illuminance can be manually varied from a first value to a second value, for example when the surgeon wants brighter or less bright light. In this case, the luminous flux can be varied by the control and/or regulation means such that the illuminance adopts the second desired value. It is ensured in this manner that a matching of the illuminance admittedly takes place on a variation of the light field, but that the illuminance can also be directly manually varied.

In accordance with a further advantageous embodiment of the method, the luminous flux of the lighting means is kept constant and a variation in the luminous flux of the surgical light is achieved by mechanical and/or optical means.

The variant of the method is in particular suitable for lighting means in which an electrical dimming results in a relatively strong variation of the color temperature and/or of the color rendering properties, which is extremely unwanted for the illumination of the operating location. In this variant of the method, the electrical power of the lighting means can be kept constant, since the variation in the luminous flux of the surgical light does not take place electrically, but by mechanical or optical means. Such mechanical and/or optical means can be mechanical diaphragms or optical filters which are moved mechanically into or in the beam path in order to bring about a reduction or an enlargement in the luminous flux discharged from the surgical light. For example, the luminous flux can be controlled by a partly light transmitting element such that the illuminance is the same with any light field variation. Lamellas arranged in cylinder form and which are arranged around the lighting means and can be pivoted together are suitable as the partly light transmitting element. There is also the possibility of pushing a partly light transmitting cylinder axially over the lighting means. A further possibility lies in dimming the luminous flux of the lighting means by a partly light transmitting diaphragm which can be arranged, for example, behind the light transmitting light masking disk. Disks with multiple perforations, which are arranged rotatably on top of one another, whereby light discharge areas of different size result, are, for example, suitable as diaphragms. Equally partly light transmitting lamella disks arranged at this position can also be provided. Generally, metal sheets with cut-outs, neutral color filter lenses, printed lenses or light filters which variable transmission, for example, liquid filters, can be used for the lamellas, the cylinder or the diaphragms.

In lighting means in which an electrical dimming does not influence the color temperature and/or the color rendering properties, or only influences them slightly, the luminous flux of the surgical light can also be varied in that the current and/or voltage of the lighting means is varied.

In accordance with a further advantageous embodiment the illuminance is reduced after exceeding a pre-set light field size in accordance with a characteristic curve in dependence on the light field size. This procedure is based on the recognition that in practice large operating fields are frequently relatively shallow and do not have such a depth as small and medium sized operating fields. Such large area operating fields of shallow depth are as a rule only illuminated with approximately 50% of the maximum illuminance, since there are here no losses due to the geometrical shape, for example, the wound passage. It is thus not necessary in this variant of the method for the surgeon to reduce the illuminance manually after a certain light field size has been exceeded.

In accordance with a further advantageous embodiment of the method, a small light field size, or the smallest light field size, is set automatically, i.e., by a motor means, by the control and/or regulation means on the switching on of the surgical light and after each repositioning of the surgical light. This procedure facilitates the adjustment of the surgical light since, on a first switching on and on a repositioning, a small light field size is always automatically set, whereby a precise positioning of the surgical light is facilitated. At the same time, a maximum permitted illuminance (e.g. 160,000 1×) can automatically be set. Starting from this small light field, the surgeon can subsequently set the light field size he desires.

The object initially named is furthermore satisfied by a surgical light which comprises at least one lighting means, a device for the variation of the light field size and a device for the adjustment of the luminous flux of the surgical light. A device for the detection of a variation in the light field and a control and/or regulation means are provided which automatically varies the luminous flux of the surgical light in dependence on the variation in the light field.

BRIEF DESCRIPTION OF THE DRAWINGS

The present disclosure will be described purely by way of example with reference to advantageous embodiments and to the enclosed drawings. There are shown:

FIG. 1 is a schematic representation of a light field produced by a surgical light and having a diameter D;

FIG. 2 is a possible characteristic curve for the setting of the illuminance E in dependence on the light field diameter D;

DETAILED DESCRIPTION

Figure 3:
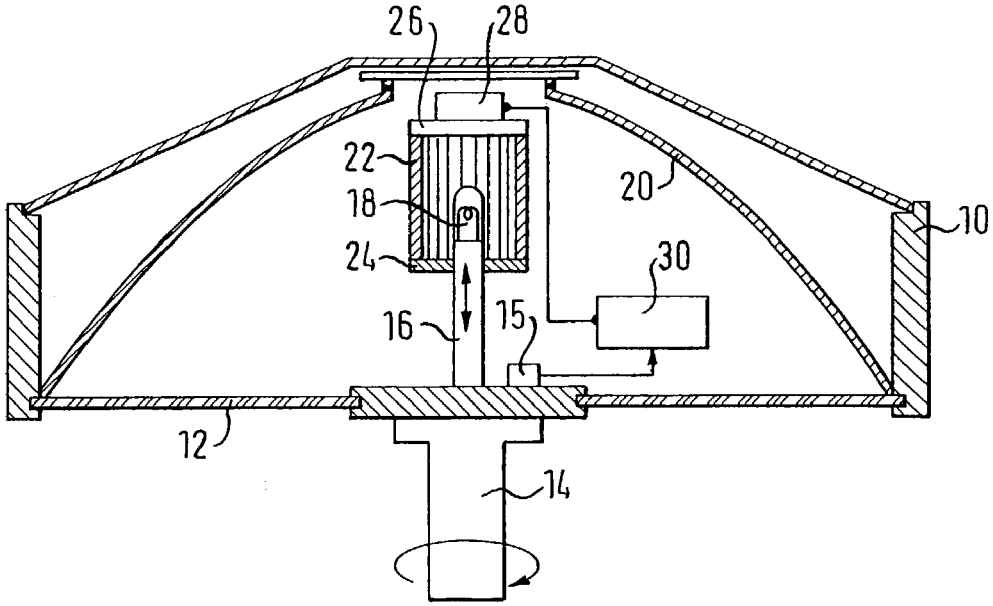
FIG. 3 is a cross-sectional view through an embodiment of a surgical light in accordance with the invention.

The following description of the surgical light is not intended to limit the scope of the invention to these preferred embodiments, but rather to enable any person skilled in the art to make and use the invention.

FIG. 1 schematically shows the light field produced by a surgical light, with the surgical light comprising a housing 10 in which a reflector 20 is arranged. A lighting means 18 is located at the center of the housing 10 and produces a luminous flux which is diverted by the reflector 20 and deflected in the direction of an operating location. The light rays pass through a protective disk 12 and form a light field in the region of the operating location which does not necessarily have to be circular and which has a diameter D, with the light field diameter being relatively constant over an axial region of approximately 50 cm in the region of the operating location due to the special configuration of the surgical light.

A variation in the light field diameter D can take place in that the lighting means 18 is moved axially in the direction of the double arrow, whereby the light cone produced is varied. The movement of the lighting means 18 can take place, for example, by rotating a handle 14 attached to the lower side of the surgical light, with this rotational movement being able to be converted mechanically or electrically into an axial movement of the lighting means 18. The possibility also exists of driving the lighting means 18 by a motor.

FIG. 3 shows a surgical light in accordance with the invention, with the same reference numerals being used as in FIG. 1 for the same components.

In the surgical light shown in FIG. 3, the lighting means 18 is axially adjustable via a rotation of the handle 14 in the direction of the double arrow via a drive 16, whereby the diameter, or the outer contour, of the light field can be varied. A rotation of the handle 14 is detected by a sensor 15, whereby a variation in the light field can be detected.

For the adjustment of the luminous flux of the surgical light, a mechanically adjustable diaphragm means is provided in the form of lamellas 22 arranged in cylinder shape next to one another. The longitudinal axis of each lamella 22 extends parallel to the longitudinal axis of the lighting means 18, with the cylinder and the lighting means extending coaxially to one another.

Every single lamella 22 can be pivoted about its longitudinal axis, with a lower part 24 and an upper part 26 being provided for the support of the lamellas. In the region of the upper part 26, a cam guide is provided which cooperates with every single lamella 22 such that a common displacement of all lamellas can take place by a drive 28 provided in the region of the upper part 26.

In the position shown in FIG. 1, all lamellas are positioned in the peripheral direction, i.e., the individual lamellas substantially form the shape of a cylinder. By actuating the drive 28, the lamellas are pivoted about their longitudinal axes such that the light emitted by the lighting means 18 can impact on the reflector 20 and, from there, can pass through the protective disk 12.

For the automatic variation of the luminous flux of the surgical light in dependence on the variation in the light field, a control and/or regulation means 30 (hereinafter: control) is provided which controls the drive 28 in dependence on the output signal of the sensor 15. The control 30 is designed here such that, on an enlargement of the light field by manual or motorized rotation of the handle 14, the lamellas 22 are opened such that the luminous flux of the surgical light is correspondingly increased in order to achieve a substantially constant value of the illuminance.

Figure 4:
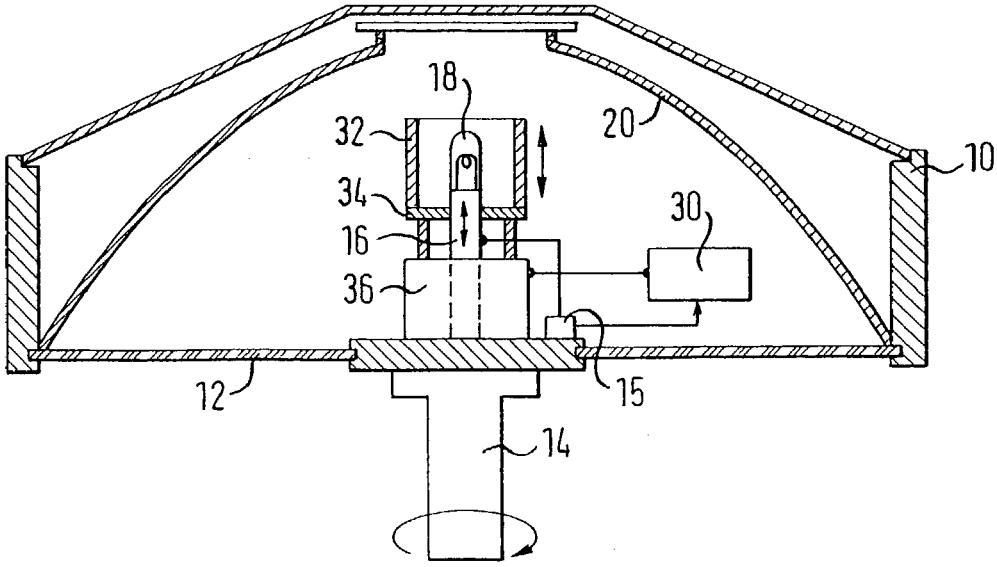
FIG. 4 is a cross-sectional view through a further embodiment of a surgical light in accordance with the invention.

FIG. 4 shows a further embodiment of a surgical light, with the same reference numerals being used for the same components.

In the embodiment shown in FIG. 4, an at least partly transparent cylinder 32 is provided in the region of the operating field as a diaphragm means for the variation of the illuminance, said cylinder 32 having a pre-determined transmittance, for example of 50%. The cylinder 32 is arranged coaxially to the longitudinal axis of the lighting means 18 and is movable axially along the double arrow shown in the direction of the longitudinal axis of the lighting means 18.

The cylinder 32 is arranged on a holder 34 which is axially movable via a spindle drive 36. The cylinder 32 is moved in the direction of the arrow by actuation of the spindle drive 36 such that the cylinder 32 can cover the lighting means 18 with different widths in the axial direction. The cylinder 32 can, for example, be moved completely out of the beam path such that no dimming effect is given. In the position shown in FIG. 4, the complete dimming effect is achieved. This amounts, for example, to 50% to 70% in dependence on the transmittance of the cylinder.

The lighting means 18 is also movable in this embodiment, and indeed with the aid of a drive 16 in the direction of the double arrow shown. In this embodiment, the drive 16 has an electric motor such that a remote controlled variation of the light field is also possible. At the same time, the light field can also be varied by rotating the handle 14. The rotation of the handle 14 is detected by the sensor 15, which controls the drive 16 correspondingly. At the same time, the output signal of the sensor 15 is transmitted to the control 30 which in turn controls the spindle drive 36 in the aforesaid manner.

FIG. 2 shows a characteristic curve stored in the control 30 which controls the illuminance E in dependence on the diameter D of the light field. As can be seen, with a light field diameter up to approximately 225 mm, a constant illuminance is set, whereas, with a light field diameter from approximately 225 mm, the illuminance is increasingly reduced.

The aforesaid lighting means 18 can either be a halogen lamp or also a discharge lamp. In this connection, discharge lamps have the advantage that very high illuminance values in the order of magnitude of 180,000 1× are possible with relatively small electrical powers, for example in the order of magnitude of 70 W. The disadvantage present in such discharge lamps of the variation of the color temperature on electrical dimming is compensated in accordance with the invention in that mechanical or optical means are provided for the dimming.

In accordance with a further embodiment (not shown), the control 30 is designed such that it initially controls the drive 36 on the switching on of the surgical light such that the smallest possible light field is set. In addition, the control 30 can be connected to sensors (not shown) which detect a movement of the surgical light, for example using braking devices or capacitive sensors. The control 30 can be made here such that, after or during a movement of the surgical light, the smallest possible light field, which can have an extent, for example, of approximately 150 mm, is set automatically with the aid of the drive 36.

The sensor for the detection of the variation of the light field can also be made as an optical sensor which, for example, determines the variation in the luminance in the region of the operating area directly or by reflection. A feedback with a dimming device of the light can also take place such that it can be distinguished whether the luminous flux or the size of the light field is varied.

As any person skilled in the art will recognize from the previous description and from the figures and claims, modifications and changes can be made to the preferred embodiments of the invention without departing from the scope of the invention defined in the following claims.

What is claimed is:

1. A method for the control of the illuminance of a surgical light comprising:

providing at least one lighting means for forming a light field in a region of an operating site;

varying the size of a diameter of the light field of the surgical light;

detecting the variation of the diameter of the light field; and varying a luminous flux of the surgical light in response to the detected variation of the diameter of the light field by at least one of a control means and a regulation means as the light field varies such that the illuminance adopts a substantially constant desired value.

2. The method in accordance with claim 1, further comprising:

selecting the luminous flux of the surgical light with a small light field smaller than the maximum possible luminous flux; and increasing the luminous flux as the light field becomes larger.

3. The method in accordance with claim 1, further comprising:

moving at least one component of the surgical light mechanically for the variation of the light field; and detecting said movement by a sensor whose output signal is used as a control variable for the variation of the luminous flux.

4. The method in accordance with claim 3, further comprising:

rotating a handle of the surgical light for the variation of the light field; and detecting said rotation by the sensor.

5. The method in accordance with claim 1, further comprising:

varying the luminous flux after a manual variation of the desired value of the illuminance from a first value to a second value, said variation being by at least one of said control means and said regulation means such that the illuminance adopts the second desired value.

6. The method in accordance with claim 1, further comprising:

maintaining the luminous flux of the lighting means constant; and varying the luminous flux of the surgical light by at least one of a mechanical means and an optical means.

7. The method in accordance with claim 1, further comprising:

varying the luminous flux of the surgical light by varying at least one of a current of the lighting means and a voltage of the lighting means.

8. The method in accordance with claim 1, further comprising:

reducing the illuminance in accordance with a pre-determined characteristic curve in dependence on the size of the light field after exceeding a pre-determined light field size.

9. The method in accordance with claim 1, further comprising:

setting a reduced light field size automatically by at least one of said control means and said regulation means in response to the switching on of the surgical light.

10. The method in accordance with claim 1, further comprising:

setting the smallest possible light field size automatically by at least one of said control means and said regulation means in response to every repositioning of the surgical light.

11. A surgical light comprising:

at least one lighting means for forming a light field in a region of an operating site;

a first device for varying a size of a diameter of the light field; and a second device for the setting of a luminous flux of the surgical light without varying the size of the diameter of the light field;

a device for the detection of the variation of the diameter of the light field; and at least one of a control means and a regulation means for the automatic variation of the luminous flux of the surgical light in dependence on the variation in the light field such that the illuminance adopts a substantially constant desired value for each selected diameter.

12. The surgical light in accordance with claim 11, further comprising:

a sensor which detects the movement of at least one component of the surgical light for the variation of the light field; and an output of the sensor being in communication with at least one of the control means and the regulation means.

13. The surgical light in accordance with claim 11, further comprising:

at least one of a mechanical means and an optical means are provided for the variation of the luminous flux of the surgical light.

14. The surgical light in accordance with claim 11, wherein a characteristic curve is stored in at least one of the control means and the regulation means which pre-sets a reduction in the illuminance dependent on the light field size after exceeding a pre-determined light field size.

15. The surgical light in accordance with claim 11, further comprising:

a device for the motorized setting of the light field size coupled to a device for the detection of a movement of the surgical light.

* * * * *